United States Patent [19]

Bianchi et al.

[11] 4,070,504

[45] Jan. 24, 1978

[54] METHOD OF PRODUCING A VALVE METAL ELECTRODE WITH VALVE METAL OXIDE SEMI-CONDUCTOR FACE AND METHODS OF MANUFACTURE AND USE

[75] Inventors: Giuseppe Bianchi, Milan, Italy; Vittorio de Nora, Nassau, Bahamas; Patrizio Gallone; Antonio Nidola, both of Milan, Italy

[73] Assignee: Diamond Shamrock Technologies, S.A., Geneva, Switzerland

[21] Appl. No.: 635,879

[22] Filed: Nov. 28, 1975

Related U.S. Application Data

[60] Division of Ser. No. 771,665, Oct. 29, 1968, Pat. No. 3,948,751, and a continuation-in-part of Ser. No. 690,407, Dec. 14, 1967, Pat. No. 3,616,445.

[51] Int. Cl.[2] ..... C25B 11/10

[52] U.S. Cl. ..... 427/126; 204/290 F; 204/98; 204/99

[58] Field of Search ..... 204/290 R, 290 F, 98, 204/99; 427/126

[56] References Cited

U.S. PATENT DOCUMENTS

| | | | |
|---|---|---|---|
| 2,940,845 | 6/1960 | Jaffee | 75/174 |
| 3,037,858 | 6/1965 | Weisert | 75/174 |
| 3,177,131 | 8/1965 | Angell | 204/290 F |
| 3,616,445 | 10/1971 | Bianchi et al. | 204/290 F |
| 3,630,768 | 12/1971 | Bianchi et al. | 427/126 |
| 3,632,498 | 1/1972 | Been | 204/290 F |
| 3,948,751 | 4/1976 | Bianchi et al. | 209/98 |

FOREIGN PATENT DOCUMENTS

| | | | |
|---|---|---|---|
| 1,147,442 | 4/1969 | United Kingdom | 204/290 F |

*Primary Examiner*—Ralph S. Kendall
*Attorney, Agent, or Firm*—Hammond & Littell

[57] ABSTRACT

Describes chlorine resistant metal electrodes, preferably of valve metals such as titanium and tantalum, having coatings of mixed metal oxides, preferably valve metal oxides and platinum group metal oxides, which have been doped to provide semi-conducting surfaces on the electrodes, which coatings also have the capacity to catalyze chlorine discharge from the electrodes and to resist corrosive conditions in a chlorine cell and methods of their manufacture and use.

20 Claims, No Drawings

METHOD OF PRODUCING A VALVE METAL ELECTRODE WITH VALVE METAL OXIDE SEMI-CONDUCTOR FACE AND METHODS OF MANUFACTURE AND USE

This application is a continuation-in-part of our copending application Ser. No. 690,407, filed Dec. 14, 1967 U.S. Pat. No. 3,616,445, and a division of application No. 771,665 filed Oct. 29, 1968, U.S. Pat. No. 3,948,751.

This invention relates to valve metal electrodes having a semi-conductive surface, of titanium dioxide or tantalum oxide, a platinum group metal other metal oxides, which is sufficiently conductive to avoid the passivation which takes place in valve metal electrodes or in valve metal electrodes having a coating of a platinum group metal thereon, when used in electrolysis processes such as, for example, the production of chlorine, and in which the semi-conductive titanium dioxide or tantalum oxide, platinum group metal oxide and other metal oxide coating is sufficiently conductive to conduct electrolysis current from the electrode base to an electrolyte at continued high amperage and lower overvoltage for chloride discharge for long periods of time.

The electrodes of our invention may be used for the electrolysis of lithium, sodium and potassium chlorides, bromides and iodides and more generally for the electrolysis of halogenides, for the electrolysis of other salts which undergo decomposition under electrolysis conditions, for the electrolysis of HCl solutions and for the electrolysis of water, etc. They may also be used for other purposes such as other processes in which an electrolysis current is passed through an electrolyte for the purpose of decomposing the electrolyte, for carrying out organic oxidations and reductions for cathodic protection and in other electrolysis processes. They may be used in mercury or diaphragm cells and may take other forms than those specifically described. The electrodes of our invention are particularly useful as anodes for the electrolysis of sodium chloride brines in mercury cells and diaphragm cells as they have the ability to liberate chlorine at low anode voltages essentially throughout the life of the titanium dioxide or tantalum oxide or other metal oxide semi-conductor coating and have a low wear rate (loss of conductor metal per ton of chlorine produced).

Valve metals, such as titanium, tantalum, zirconium, molybdeum, columbium and tungsten, have the capacity to conduct current in the anodic direction and to resist the passage of current from the cathodic direction and are sufficiently resistant to the electrolyte and conditions within an electrolytic cell used, for example, for the production of chlorine and caustic soda, to be used as electrodes in electrolytic processes. In the anodic direction, however, their resistance to the passage of current goes up rapidly, due to the formation of an oxide layer thereon, so that it is no longer possible to conduct current to the electrolyte in any substantial amount without substantial increase in voltage which makes continued use of uncoated valve metal anodes in the electrolytic process uneconomical.

When valve metal anodes are coated with platinum or platinum group metal conductors, these too become passivated causing a rapid rise in potential after being used for a short time at sufficiently high current density under chlorine discharge. This rise in potential indicates that the anodic oxidation of the dissolved chloride ion to molecular chlorine gas will proceed only at a higher overvoltage because of the diminished catalytic activity of the electrode surface.

Attempts to overcome this passivation (after a short period of use) by providing titanium or tantalum anodes with a coating of a platinum group metal applied by electro-deposition or by thermal processes, but essentially covering the entire face of the titanium anode facing the cathode, have not been commercially successful. The coatings did not always adhere properly and the consumption of the platinum group metal was high and the results were unsatisfactory.

It has long been known that rutile or titanium dioxide and tantalum oxide have semi-conducting properties, either when doped with traces of other elements or compounds which disturb the lattice structure and change the conductivity of the titanium dioxide or tantalum oxide, or when the lattice is disturbed by the removal of oxygen from the titanium dioxide or tantalum oxide crystal. Titanium dioxide has been doped with tantalum, niobium, chromium, vanadium, tin, nickel and iron oxides and other materials to change the electrical conducting or the semi-conducting properties of the titanium dioxide, and by changing the stoichiometric balance by removing oxygen from the crystal lattice. Likewise, $Ta_2O_5$ films have had their conductivity altered by untraviolet radiation and by other methods, but no one has suggested the use of doped titanium dioxide or tantalum oxide to provide a conductive or semi-conductive face on a valve metal electrode for use in electrochemical reactions. Other metal oxides when intimately mixed and heated together have the property of forming semi-conductors, particularly mixed oxides of metals belonging to adjacent groups in the Periodic Table.

Various theories have been advanced to explain the conductive or semi-conductive properties of doped or undoped titanium dioxide, also for $Ta_2O_5$. See, for example, Grant, Review of Modern Physics, Vol. 1, page 646 (1959), Frederikse, Journal of Applied Physics, Supplement to Vol. 32, No. 10, page 221 (1961) and Vermilyea, Journal of the Electrochemical Society, Vol. 104, page 212 (1957), but there appears to be no general agreement as to what gives doped titanium dioxide and tantalum oxide their properties of semi-conduction. When other mixed metal oxides are used to produce semi-conductors, it is possible that oxides of one metal belonging to an adjacent group in the Periodic Table penetrates into the crystal lattice of the other metal oxide by solid solution to act as a doping oxide which disturbs the stoichiometric structure of the crystals of one of the metal oxides to give the mixed oxide coating its semi-conducting properties.

One of the objects of this invention is to provide an electrode having a metal base and a semi-conducting mixed metal oxide coating over part or all of said base sufficient to conduct an electrolysis current from said base to an electrolyte over long periods of time without passivation.

Another object is to provide an anode having a valve metal base with a coating over part or all of the surface thereof, consisting primarily of titanium dioxide or tantalum oxide which has conducting or semi-conducting properties sufficient to conduct an electrolysis current from the base to an electrolyte over long periods of time without passivation.

Another object of the invention is to provide a valve metal electrode having a conducting surface consisting primarily of titanium dioxide or doped titanium dioxide or tantalum oxide or doped tantalum oxide or mixed metal oxides from adjacent groups in the Periodic Table.

Another object of our invention is to provide a valve metal electrode having a semi-conductive surface consisting primarily of titanium dioxide or tantalum oxide or mixed metal oxides in which the semi-conductive surface has the properties of catalyzing chlorine discharge from the surface of the electrode without increase in overvoltage as hereindefined over long periods of time.

Another object of our invention is to provide a metal electrode having a semi-conducting face of doped titanium dioxide or doped tantalum oxide or doped metal oxides in which the metal oxide and the doping oxide are baked on the cleaned electrode face to cause a solid solution to be formed between the titanium dioxide or tantalum oxide or other metal oxide and the doping composition which will resist separation of the semi-conducting face from the metal electrode base.

Another object of our invention is to provide a valve metal electrode having a semi-conducting face of doped titanium dioxide or doped tantalum oxide or other doped metal oxide in which the doping composition and the doped metal oxide are baked on the cleaned electrode face in multiple layers to cause a solid solution to be formed between the titanium dioxide, tantalum oxide or other metal oxide and the doping composition.

Another object of our invention is to provide a valve metal electrode with a valve metal oxide semi-conductor coating which will have greater adherence to the base than the platinum group metal coatings of the prior art.

Various other objects and advantages of our invention will appear as this description proceeds.

In general, we prefer to make a solution of the semi-conductor metal and the doping composition in such form that when applied and baked on the cleaned valve metal electrode the solution will form $TiO_2$ plus doping oxide or $Ta_2O_5$ plus doping oxide or other metal oxide plus doping oxide and to bake this composition on the valve metal electrode in multiple layers so as to form a solid solution of the $TiO_2$, $Ta_2O_5$ or other metal oxide and the doping oxide on the face of the electrode which will have the desired semi-conducting properties and will continue chloride discharge without increase in overvoltage over long periods of time. Any solutions or compounds which on baking will form $TiO_2$ plus doping oxide, $Ta_2O_5$ plus doping oxide or other metal oxide plus doping oxide may be used, such as, chlorides, nitrates, sulfides, etc., and the solutions given below are only by way of example.

"Overvoltage" as used above may be defined as the voltage in excess of the reversible or equilibrium E.M.F. which must be applied to cause the electrode reaction to take place at the desired rate. Chlorine overvoltage varies with the anode material and its physical condition. It increases with anode current density but decreases with increase in temperature.

Titanium dioxide, tantalum oxide and other metal oxide semi-conductor faces may be produced by doping titanium dioxide, tantalum oxide or other metal oxide crystals with various doping compositions or by disturbing the stoichiometric lattice by removing oxygen therefrom to cause the $TiO_2$, $Ta_2O_5$ or other metal oxides to become semi-conductive. Because of the tendency of the $TiO_2$, $Ta_2O_5$ or other metal oxide crystals to become reoxidized, we prefer to form the semi-conductive faces on our electrodes by the use of doping compositions which in baking form solid solutions with the $TiO_2$, $Ta_2O_5$ or other metal oxide crystals which are more resistant to change during electrolysis processes. However, semi-conducting coatings produced by withdrawing oxygen from the $TiO_2$, $Ta_2O_5$ or other oxide lattices to cause lattice defects or deficiencies may be used on our electrodes.

Various doping materials which introduce impurities into the $TiO_2$ and $Ta_2O_5$ crystals to make them semi-conductive, may be used to increase the conductivity and electrocatalytic properties of the $TiO_2$ and $Ta_2O_5$ layer on the electrode, such as $WO_2$, $P_2O_5$, $Sb_2O_5$, $V_2O_5$, $Ta_2O_5$, $Nb_2O_5$, $B_2O_3$, $Cr_2O_3$, BeO, $Na_2O$, CaO, SrO, $RuO_2$, $IrO_2$, $PbO_2$, $OsO_2$, $PtO_2$, $AuO_2$, $AgO_2$, $SnO_2$, $Al_2O_3$, and mixtures thereof. We have secured best results with doping compositions for $TiO_2$ which have the tetragonal rutile-type structure with similar unit cell dimensions and approximately the same cationic radii (0.68 A). Thus, $RuO_2$ (0.65 A) and $IrO_2$ (0.66 A) are especially suitable doping compositions as well as other oxides of metals of the platinum group (i.e., platinum, palladium, osmium and rhodium) when the titanium in the coating solution has been converted to the pertitanate as described in Examples I to IV and VI to X. $IrO_2$ forms solid solutions in $TiO_2$ up to about 5 mole percent $IrO_2$ when heated together at 1040° C. At lower temperatures, the amount of $IrO_2$ which will form solid solutions in $TiO_2$ is lower but the amount of platinum metal oxide group which is not in solid solution continues to act as a catalyst for chlorine discharge.

Oxides of metals from Group VIII of the Periodic Table of elements as well as oxides of metals of Group VB, Group VIB, oxides of metals from Group IB and oxides of elements from Group VA, as well as mixtures of these oxides capable on baking of forming solid solution crystals with $TiO_2$ and $Ta_2O_5$ and of interrupting the crystal lattice of $TiO_2$ and $Ta_2O_5$ may be used to form semi-conductor and electrocatalytic coatings on valve metal electrodes such as titanium and tantalum.

In forming semi-conductor coatings for valve metal electrodes from other metal oxides, it is preferable to use mixed oxides of metals, or materials which form mixed oxides of metals, from adjacent groups of the Periodic Table, such as, for example, iron and rhenium; titanium, tantalum and vanadium; titanium and lanthanum. Other oxides which may be used are manganese and tin; molybdenum and iron; cobalt and antimony; rhenium and manganese and other metal oxide compositions.

The percentage of the doping compositions may vary from 0.10 to 50% of the $TiO_2$, $Ta_2O_5$ or other metal oxide and surprising increases in conductivity of the $TiO_2$, $Ta_2O_5$ or other metal oxide facing can be gotten with as little as 0.25 to 1% of the doping composition to the $TiO_2$, $Ta_2O_5$ or other metal oxide in the conductor face on the electrode. We prefer, however, to use sufficient excess of the doping metal oxide to provide a coating on our anodes which will catalyze chlorine discharge without material overvoltage.

The conductive coating of our invention may be applied in various ways, and to various forms of titanium or tantalum base anodes, such as solid rolled massive titanium plates, perforated plates, slitted, reticulated, titanium plates, titanium mesh and rolled titanium mesh, woven titanium wire or screen, titanium rods and bars or similar tantalum and other metal plates and shapes. Our prefered method of application is by chemi-deposition in the form of solutions painted, dipped or sprayed on or applied as curtain or electrostatic spray coatings, baked on the anode base, but other methods of application, including electrophoretic deposition of electrodeposition, may be used. Care must be taken that no air bubbles are entrapped in the coating and that the heating temperature is below that which causes warping of the base material.

We have found that it is not necessary to cover the metal base of anodes, such as titanium or tantalum, with a conductive layer of a platinum group metal over the entire surface, but that a coating made of a valve metal oxide or oxyhalogenide, such as, for instance, titanium oxide, titanium oxychloride, tantlum oxide, tantalum oxychloride, zirconium oxide or oxyfluoride, may also develop electrocatalytic properties, if its structure is modified by the addition of platinum group and noble metals, either as such or in the form of oxides or oxyhalogenides.

The spectrum of doped $TiO_2$ samples shows that the foreign ion replaces the Ti ion on a regular lattice site and causes a hyperfine splitting in accordance with the nuclear spin of the substituting element.

In all applications, the titanium, tantalum or other metal base is preferably cleaned and free of oxide or other scale. This cleaning can be done in any way, by mechanical or chemical cleaning, such as, by sand blasting, etching, pickling or the like.

The following examples are by way of illustration only and various modifications and changes may be made in the compositions and form of solutions given, and in the baking procedure used and in other steps within the scope of our invention.

EXAMPLE I

Titanium trichloride in HCl solution is dissolved in methanol, the $TiCl_3$ is converted to the pertitanate by the addition of $H_2O_2$. This conversion is indicated by a change in color from $TiCl_3$ (purple) to $Ti_2O_5$ (orange). An excess of $H_2O_2$ is used to insure complete conversion to the pertitanate. Sufficient $RuCl_3 . 3H_2O$ is dissolved in methanol to give the desired final ratio of $TiO_2$ to $RuO_2$. The solution of pertitanic acid and ruthenium trichloride are mixed and the resulting solution is applied to both sides of a cleaned titanium anode surface and to the intermediate surfaces by brushing. The coating is applied as a series of coats with baking at about 350° C for 5 minutes between each coat. After a coating of the desired thickness or weight per unit of area has been applied, the deposit is given a final heat treatment at about 450° C for 15 minutes to 1 hour. The molar ratio of $TiO_2$ to $RuO_2$ may vary from 1:1 $TiO_2 : RuO_2$ to 10:1 $TiO_2 : RuO_2$. The molar values correspond to 22.3:47 weight percent Ti : Ru and 51:10.8 weight percent Ti : Ru.

Anodes produced according to this example will resist amalgam immersion and have a high electrochemical activity in chlorine cells which continues without material diminution over a long period of time.

The thickness of the coating may be varied according to the electrochemical needs. A typical coating to give 46 mg Ru metal and 80 mg titanium in the oxide coating for every 6 sq. in. of anode surface may be prepared by using 117.5 mg $RuCl_3 . 3H_2O$ (39% Ru metal) and 80 mg of titanium metal as $TiCl_3$ (80 mg TI dissolved in dilute HCl sufficiently in excess to maintain acidic conditions). Methanol is added to the titanium trichloride solution and the solution is oxidized with $H_2O_2$ to produce the pertitanate. The resulting solution is painted on a titanium anode substrate in multiple coats with drying or backing at 350° C for 5 minutes between each coat. 13 coats were required before all the solution was applied. A final heat treatment at 450° C for 1 hour was given to complete the semi-conductive coating. The molar ratio of Ti to Ru or $TiO_2$ to $RuO_2$ was 3.65:1

EXAMPLE II

An expanded titanium anode plate, with a surface of 50 $cm^2$ projected area, was cleaned by boiling at reflux temperature of 110° C in a 20% solution of hydrochloric acid for 40 minutes. It was then given a liquid coating containing the following materials:

Ruthenium as $RuCl_3.H_2O$ — 10 mg (metal)
Iridium as $(NH_4)_2 IrCl_6$ — 10 mg (metal)
Titanium as $TiCl_3$ — 56 mg (metal)
Formamide ($HCONH_2$) — 10 to 12 drops
Hydrogen peroxide ($H_2O_2$ 30%) — 3 to 4 drops The coating was prepared by first blending or mixing the ruthenium and iridium salts containing the required amount of Ru and Ir in a 2 molar solution of hydrochloric acid (5 ml are sufficient for the above amounts) and allowing the mixture to dry at a temperature not higher than 50° C until a dry precipitate is formed. Formamide is then added to the dry salt mixture at about 40° C to dissolve the mixture. The titanium chloride, $TiCl_3$, dissolved in hydrochloric acid (15% strength commercial solution), is added to the dissolved Ru-Ir salt mixture and a few drops of hydrogen peroxide (30% $H_2O_2$) are added, sufficient to make the solution turn from the blue color of the commercial solution of $TiCl_3$, to an orange color.

This coating mixture was applied to both sides of the cleaned titanium anode base, by brush, in eight subsequent layers, taking care to brush the coating into the interstices of the expanded plate. After applying each layer, the anode was heated in an oven under forced air circulation at a temperature between 300° and 350° C for 10 to 15 minutes, followed by fast natural cooling in air between each of the first seven layers, and after the eighth layer was applied the anode was heated at 450° C for 1 hour under forced air circulation and then cooled.

The amounts of the three metals in the coating correspond to the weight ratios of 13.15% Ir, 13.15% Ru and 73.7% Ti and the amount of noble metal in the coating corresponds to 0.2 mg Ir and 0.2 mg Ru per square centimeter of projected electrode area. It is believed that the improved qualities of this anode are due to the fact that although the three metals in the coating mixture are originally present as chlorides, they are co-deposited on the titanium base in oxide form. Other solutions which will deposit the metals in oxide form may of course be used. In accelerated testing, the anode of this example showed a weight loss of zero after three current reversals, a loss of 0.152 mg/$cm^2$ after three amalgam dips as against a weight loss of 0.93 mg/$cm^2$ of a similar titanium base anode covered with ruthenium oxide. After 2,000 hours of operation this anode showed a weight increase of 0.7 mg/$cm^2$, whereas similar anodes covered with a layer of platinum or ruthenium oxide showed substantial weight losses. The weight increase has apparently become stabilized.

EXAMPLE III

The coating mixture was applied to a cleaned titanium anode base of the same dimensions as in Example II according to the same procedure. The applied mixture consisted of the following amounts:

Ruthenium as $RuCl_3.H_2O$ — 20 mg (metal)
Iridium as $(NH_4)_2IrCl_6$ — 20 mg (metal)
Titanium as $TiCl_3$ — 48 mg (metal)
Formamide ($HCONH_2$) — 10 to 12 drops
Hydrogen peroxide ($H_2O_2$ 30%) — 3 to 4 drops The procedure for compounding the coating and applying it to the titanium base was the same as in Example II. The quantities of the three metals in this mixture corresponded to the weight ratios of 22.6% Ir, 22.6% Ru and 54.8% Ti and the amount of noble metal oxide in the active coating correspond to 0.4 mg Ir, and 0.4 mg Ru per square centimeter of the active electrode area. After 2,300 hours of operation this anode showed a weight increase of 0.9 mg/cm$^2$ which had apparently become stabilized.

EXAMPLE IV

Before being coated, a titanium anode substrate after pre-etching as described in Example II, was immersed in a solution composed of 1 molar solution of $H_2O_2$ plus a 1 molar solution of NaOH at 20° to 30° C for two days. The surface of the titanium was thus converted to a thin layer of black titanium oxide.

The coating mixture of the same composition as given in Example II was used, except that isopropyl alcohol was used as the solvent in place of formamide. The use of isopropyl alcohol resulted in a more uniform distribution of the coating films on the black titanium oxide substrate than when formamide was used as the solvent.

EXAMPLE V

An expanded titanium anode plate of the same size as in the former examples was submitted to the cleaning and etching procedure as described above and then given a liquid coating containing the following materials:

Ruthenium as $RuCl_3.H_2O$ — 10 mg (metal)
Iridium as $IrCl_4$ — 10 mg (metal)
Tantalum as $TaCl_5$ — 80 mg (metal)
Isopropyl alcohol — 5 drops
Hydrochloric acid (20%) — 5 ml The coating was prepared by first blending or mixing the ruthenium and iridium salts in 5 ml of 20% HCl. The volume of this solution was then reduced to about one-fifth by heating at a temperature of 85° C. The required amount of $TaCl_5$ was dissolved in boiling 20% HCl so as to form a solution containing about 8% $TaCl_5$ by weight. The two solutions were mixed together and the overall volume reduced to about one-half by heating at 60° C. The specified quantity of isopropyl alcohol was then added.

The coating mixture was applied to both sides of the cleaned titanium anode base in eight subsequent layers and following the same heating and cooling procedure between each coat and after the final coat as described in Example II.

The amounts of the three metals in the coating correspond to the weight ratios of 10% Ru, 10% Ir and 80% Ta and the amount of noble metal in the coating corresponds to 0.2 mg Ir and 0.2 mg Ru per square centimeter of projected electrode area. In accelerated testing, this anode showed a weight loss of 0.0207 mg/cm$^2$ after three current reversals and a loss of 0.0138 after two amalgam dips. After 514 hours of operation, this anode showed a weight decrease of 0.097 mg/cm$^2$.

EXAMPLE VI

An expanded titanium anode plate of the same size as in the former examples, after cleaning and etching, was given a liquid coating containing the following materials:

Ruthenium as $RuCl_3.H_2O$ — 11.25 mg (metal)
Gold as $HAuCl_4.nH_2O$ — 3.75 mg (metal)
Titanium as $TiCl_3$ — 60 mg (metal)
Isopropyl alcohol — 5 - 10 drops
Hydrogen peroxide (30%) — 2 - 3 drops The coating was prepared by first blending the ruthenium and gold salts in the required amount in a 2 molar solution of hydrochloric acid (5 ml) and allowing the mixture to dry at a temperature of 50° C. The commercial solution of $TiCl_3$ was then added to the Ru-Au salt mixture and a few drops of hydrogen peroxide were stirred into the solution, sufficient to make the solution turn from blue to orange. Isopropyl alcohol was finally added in the required amount. The coating mixture thus prepared was applied to both sides of the cleaned titanium anode base in eight subsequent layers, following the same heating and cooling procedure as described in Example II.

The amounts of the three metals in the coating correspond to the weight ratios of 15% Ru, 5% Au, 80% Ti and the amount of noble metal in the coating corresponds to 0.225 mg Ru and 0.075 mg Au per square centimeter of projected electrode area. In accelerated testing, this anode showed a weight loss of 0.030 mg/cm$^2$ after three current reversals and a loss of 0.043 mg/cm$^2$ after two amalgam dips. After 514 hours of operation this anode showed a weight change of +0.2 mg/cm$^2$.

EXAMPLE VII

An expanded titanium anode plate was submitted to a cleaning and etching procedure and then given a liquid coating containing the following materials:

Ruthenium as $RuCl_3.3H_2O$ — 0.8 mg/cm$^2$ (metal)
Titanium as $TiCl_3$ — 0.89 mg/cm$^2$ (metal)
Tantalum as $TaCl_5$ — 0.089 mg/cm$^2$(metal)

The coating mixture was prepared by first blending the dry ruthenium salt in the commercial hydrochloric acid solution containing 15% $TiCl_3$. Tantalum was then added in the above proportion and in the form of a solution of 50 g/l $TaCl_5$ in 20% HCl. The blue color of the solution was made to turn from blue to orange by introducing the necessary amount of hydrogen peroxide, which was followed by an addition of isopropyl alcohol as a thickening agent. The coating mixture was applied to both sides of the titanium anode base by electrostatic spray coating in four subsequent layers. The number of layers can be varied and it is sometimes preferable to apply several coats on the area facing the cathode and only one coat, preferably, the first coat, on the area away from the cathode. After applying each layer, the anode was heated in an oven under forced air circulation at a temperature between 300° and 350° C for 10 to 15 minutes, followed by fast natural cooling in air between each of the first three layers and after the fourth layer was applied the anode was heated at 450° C for one hour under forced air circulation and then cooled.

The amounts of the three metals in the coating correspond to the weight ratios of 45% Ru, 50% Ti, 5% Ta.

In accelerated testing this anode showed no appreciable weight loss after two current reversal cycles and after two amalgam dips. Each current reversal cycle consisted of a sequence of five anodic polarizations at 1 A/cm², each lasting 2 minutes and followed by a cathodic polarization at the same current density and for the same time. After more than 1500 hours of operation at 3 A/cm² in saturated sodium chloride solution, the anode potential was 1.41 V.

EXAMPLE VIII

An expanded titanium anode plate was submitted to a cleaning and etching procedure and then given a liquid coating containing the following materials:

Ruthenium as $RuCl_3.3H_2O$ — 0.6 mg/cm² (metal)
Titanium as $TiCl_3$ — 0.94 mg/cm² (metal)
Tin as $SnCl_4$ — 0.17 mg/cm² (metal)

The coating was prepared by first blending the dry ruthenium salt in the commercial hydrochloric acid solution with 15% $TiCl_3$. Tin tetrachloride was then stirred into the mixture in the above proportion, followed by sufficient hydrogen peroxide to cause the blue color of the solution to turn to orange. Isopropyl alcohol was added as a thickening agent. The coating mixture was applied to both sides of the pre-cleaned and pre-etched titanium anode base in four subsequent layers and each layer was submitted to the usual thermal treatment as described in Example VII. The amounts of the three metals in the coating correspond to the weight ratios of 35% Ru, 55% Ti, 10% Sn. In accelerated testing the anode showed a weight loss of 0.09 mg/cm² after two current reversal cycles as described in Example VII and a weight loss of 0.01 mg/cm² after one amalgam dip. After more than 1500 hours of operation in concentrated NaCl solution at 2 A/cm² and 60° C, the anode potential was 1.42 V.

EXAMPLE IX

A pre-cleaned titanium anode plate was coated with a coating mixture consisting of a hydrochloric acid solution containing the following salts:

Ruthenium as $RuCl_3.3H_2O$ — 0.8 mg/cm² (metal)
Titanium as $TiCl_3$ — 0.96 mg/cm² (metal)
Aluminum as $AlCl_3.6H_2O$ — 0.018 mg/cm² (metal)

The mixture was prepared by first blending the ruthenium and titanium salts in the commercial hydrochloric acid solution of $TiCl_3$, as described in the former examples. Aluminum trichloride was added in the above proportion, followed by treatment with hydrogen peroxide as in Example VII and isopropyl alcohol was added as a thickening agent. The mixture was applied to the pre-cleaned and pre-etched titanium anode base in four subsequent layers, taking care to apply the coating to both sides of the base and to the exposed areas between the top and bottom surfaces of the anode base. Thermal treatment procedure after each layer was as described in Example VII.

The amounts of the three metals in the coating correspond to weight ratios of 45% Ru, 54% Ti and 1% Al. After one current reversal cycle and two amalgam dips, the overall weight loss was 0.1 mg/cm². After operating for more than 1500 hours in concentrated sodium chloride solution at 60° C under an anodic current density of 3A/cm², the anode potential was 1.42 V.

EXAMPLE X

An expanded tantalum anode plate was submitted to a cleaning and etching procedure and then given a liquid coating containing the following materials:

Ruthenium as $RuCl_3.3H_2O$ — 0.8 mg/cm² (metal) p1
Titanium as $TiCl_3$ — 0.89 mg/cm² (metal)
Tantalum as $TaCl_5$ — 0.089 mg/cm² (metal)

The coating mixture was prepared by first blending the dry ruthenium salt in the commercial hydrochloric acid solution containing 15% $TiCl_3$. Tantalum was then added in the above proportion and in the form of a solution of 50 g/l $TaCl_5$ in 20% HCl. The blue color of the solution was made to turn from blue to orange by introducing the necessary amount of hydrogen peroxide, which was followed by an addition of isopropyl alcohol as a thickening agent. The coating mixture was applied to both sides of the tantalum anode base by brush in four subsequent layers. After applying each layer, the anode was heated in an oven under forced air circulation at a temperature between 300° and 350° C for 10 to 15 minutes, followed by fast natural cooling in air between each of the first three layers and after the fourth layer was applied the anode was heated at 450° C for 1 hour under forced circulation and then cooled.

The amounts of the three metals in the coating correspond to the weight ratios of 45% Ru, 50% Ti, 5% Ta.

X-ray diffraction analysis indicates that the coatings on the above anodes are in the form of semi-conducting rutile in which the doping oxides have become diffused in the rutile crystals by solid solution to give the valve metal anode base a semi-conducting rutile face with ability to oxidize dissolved chloride ions to molecular chlorine gas. The coatings may be applied and fixed upon tantalum electrode bases in a similar manner.

While semi-conducting faces may be applied to titanium or tantalum bases with other doping compositions, our tests so far have shown that when using the formulations and deposition methods described the presence of titanium or tantalum oxide and iridium alone, i.e., without ruthenium oxide, give a deposit of low activity with a higher chlorine discharge potential.

EXAMPLE XI

The coating mixture consisted of an HCl solution containing the following salts:

Manganese as $Mn(NO_3)_2$ — 0.5 mg/cm² (metal)
Tin as $SnCl_4.5H_2O$ — 0.5 mg/cm² (metal)

The solution was prepared by first blending the two salts in 0.5 ml of 20% HCl for each mg of overall salt amount, and then adding 0.5 ml of formamide. The solution was heated at 40° - 45° C until reaching complete dissolution, and then applied in six subsequent coatings on the pre-etched titanium base with a thermal treatment after each layer as formerly described. The anodic potential under chlorine discharge in saturated brine at 60° C was 1.98 V at the current density of 1 A/cm².

EXAMPLE XII

Using the same procedure as described in Example XI, the following binary salt mixture was applied to the titanium base electrode:

Molybdenum as $Mo_2(NH_4)_2O_7$ — 0.5 mg/cm² (metal)
Iron as $FeCl_3$ — 0.5 mg/cm² (metal)

The anodic potential measured as in Example XI was 2. O.V.

EXAMPLE XIII

Using the same procedure as in Example XI, the following binary mixture was applied to a titanium base electrode:

Cobalt as $CoCl_2$ — 0.5 mg/cm² (metal)

Antimony as $SbCl_3.(COOH)_2(CHOH)_2$ — 0.5 mg/cm² (metal)

The anodic potential measured as in the former examples was 2.05 V.

EXAMPLE XIV

The binary mixture applied to the titanium base electrode according to the procedure of former Example XI was as follows:

Rhenium as $(NH_4)_2ReCl_6$ — 0.5 mg/cm² (metal)

Iron as $FeCl_3$ — 0.5 mg/cm² (metal)

The anodic potential measured as in the former examples was 1.46 V.

EXAMPLE XV

The binary mixture applied to the titanium base electrode consisted of the following salts:

Rhenium as $(NH_4)_2ReCl_6$ — 0.5 mg/cm² (metal)

Manganese as $Mn(NO_3)_2$ — 0.5 mg/cm² (metal)

The mixture was prepared and applied following the same procedure as described for the former examples, with multiple coats with heating between each coat and after the final coat. The anodic potential in saturated sodium chloride brine at 60° C and at 1 A/cm² was 1.8 V.

EXAMPLE XVI

The binary mixture applied to the titanium base electrode consisted of the following salts:

Rhenium as $(NH_4)_2ReCl_6$ — 0.5 mg/cm² (metal)

Zinc as $ZnCl_2$ — 0.5 mg/cm² (metal)

It was prepared and applied as described in Example XI. The anodic potential under the same conditions was 1.40 V.

EXAMPLE XVII

A mixture of three salts in HCl solution was applied to the titanium base electrode, as follows:

| | | | |
|---|---|---|---|
| Rhenium | as $(NH_4)_2ReCl_6$ | 0.4 | mg/cm² (metal) |
| Iron | as $FeCl_3$ | 0.3 | " |
| Tin | as $SnCl_4 . 5H_2O$ | 0.3 | " |

The salts were dissolved in a mixture composed of 0.5 ml of 20% HCl and 0.5 ml of formamide for each mg of overall metal amount. The mixture was applied on a pre-etched titanium base and on a pre-etched tantalum base, as described in EXAMPLE XI. In both cases, the anodic potential in saturated NaCl solution and at 1 A/cm² was 1.58 V.

EXAMPLE XVIII

Electrodes were made with five different coating types, each of which consisted of a four-component salt mixture including a ruthenium salt.

| | | |
|---|---|---|
| Sample No. 1 | | |
| Titanium as $TiCl_3$ in HCl solution (commmercial) | 1.14 | mg/cm² (metal) |
| Vanadium as $VOCl_2 . 2H_2O$ in HCl solution (commercial) | 0.071 | " |
| Tantalum as $TaCl_5$ in HCl solution (commercial) | 0.017 | " |
| Ruthenium as $RuCl_3 . 3H_2O$ | 0.53 | " |
| Sample No. 2 | | |
| Titanium as $TiCl_3$ in HCl solution (commercial) | 1.06 | " |
| Tantalum as $TaCl_5$ in HCl solution (commercial) | 0.088 | " |
| Tin as $SnCl_4 . 5H_2O$ | 0.088 | " |

-continued

| | | |
|---|---|---|
| Sample No. 1 | | |
| Ruthenium as $RuCl_3 . 3H_2O$ | 0.53 | " |
| Sample No. 3 | | |
| Titanium as $TiCl_3$ in HCl solution (commercial) | 0.96 | " |
| Lanthanum as $La(NO_3)_3 . 8H_2O$ | 0.071 | " |
| Tin as $SnCl_4 . 5H_2O$ | 0.25 | " |
| Ruthenium as $RuCl_3 . 3H_2O$ | 0.53 | " |
| Sample No. 4 | | |
| Titanium as $TiCl_3$ in HCl solution (commercial) | 1.07 | " |
| Chromium as $Cr(NO_3)_3 . 8H_2O$ | 0.088 | " |
| Tin as $SnCl_4 . 5H_2O$ | 0.088 | " |
| Ruthenium as $RuCl_3 . 3H_2O$ | 0.53 | " |
| Sample No. 5 | | |
| Titanium as $TiCl_3$ in HCl solution (commercial) | 0.88 | " |
| Aluminum as $AlCl_3 . 6H_2O$ | 0.088 | " |
| Tin as $SnCl_4 . 5H_2O$ | 0.088 | " |
| Ruthenium as $RuCl_3 . 3H_2O$ | 0.071 | " |

Each sample was prepared by first blending the ruthenium salt in the commercial hydrochloric acid solution of $TiCl_3$ and adding hydrogen peroxide in the amount required to obtain a color change from blue to red. To this mixture were added the other salts in the stated proportions plus 0.56 ml of isopropanol for each mg of overall metal amount. The five mixtures were applied on five separate titanium plates in five subsequent coatings. Heat treatment at 350° C for 10 minutes was given between each coating and the next. A final treatment at 450° C for 1 hour followed the last coating.

Anodic tests were carried out in saturated NaCl brine at 60° C at a current density of 1 A/cm². The measured electrode potentials were as follows:

| | | |
|---|---|---|
| Sample | No. 1 | 1.42 V |
| " | No. 2 | 1.40 V |
| " | No. 3 | 1.39 V |
| " | No. 4 | 1.44 V |
| " | No. 5 | 1.39 V |

EXAMPLE XIX

Four coating types were tested, each of which consisted of a four component salt mixture, including a noble metal salt.

| | | |
|---|---|---|
| Sample No. 1 | | |
| Titanium as $TiCl_3$ in HCl solution (commercial) | 0.7 | mg/cm² (metal) |
| Lanthanum as $La(NO_3)_3 . 8H_2O$ | 0.088 | " |
| Tin as $SnCl_4 . 5H_2O$ | 0.15 | " |
| Platinum as $PtCl_4 . nH_2O$ (commercial) | 0.85 | " |
| Sample No. 2 | | |
| Titanium as $TiCl_3$ in HCl solution (commercial) | 0.7 | " |
| Lanthanum as $La(NO_3)_3 . 8H_2O$ | 0.088 | " |
| Tin as $SnCl_4 . 5H_2O$ | 0.15 | " |
| Rhodium as $(NH_4)_2RhCl_6$ | 0.85 | " |
| Sample No. 3 | | |
| Titanium as $TiCl_3$ in HCl solution (commercial) | 0.7 | " |
| Aluminum as $AlCl_3 . 6H_2O$ | 0.088 | " |
| Tin as $SnCl_4 . 5H_2O$ | 0.15 | " |
| Iridium as $IrCl_4$ | 0.85 | " |
| Sample No. 4 | | |
| Titanium as $TiCl_3$ in HCl solution (commercial) | 0.7 | " |
| Aluminum as $AlCl_3 . 6H_2O$ | 0.088 | " |
| Tin as $SnCl_4 . 5H_2O$ | 0.15 | " |
| Palladium as $PdCl_2$ | 0.85 | " |

The four mixtures were applied on five separate titanium and on five separate tantalum plates in five subsequent coatings. Intermediate and final heat treatments were given as in Example XVIII. The anodic potentials, measured under the same conditions as in the former example, were the following:

| | | |
|---|---|---|
| Sample | No. 1 | 1.45 V |
| " | No. 2 | 1.85 V |
| " | No. 3 | 1.37 V |
| " | No. 4 | 1.39 V |

The anodes produced according to Examples I to X showed the following advantages when compared to titanium base anodes covered with platinum group metals by electroplating or chemi-deposition.

TABLE I

| Sample | Accelerated Weight Loss Tests: Current Reversal mg/cm² | Amalgam Dip mg/cm² | Total |
|---|---|---|---|
| B (Ex. II) Ir 0.2 mg/cm² Ru 0.2 mg/cm² Ti 1.12 mg/cm² | zero | 0.152 | 0.152 |
| C (Ex. IV) Ir 0.2 mg/cm² Ru 0.2 mg/cm² Ti 1.12 mg/cm² with black oxide treatment of titanium base | zero | 0.068 | 0.068 |
| D (Ex. V) Ir 0.2 mg/cm² Ru 0.2 mg/cm² Ta 1.6 mg/cm² | 0.0207 | 0.0138 | 0.0345 |
| E (Ex. VI) Au 0.075 mg/cm² Ru 0.225 mb/cm² Ti 1.2 mg/cm² | 0.030 | 0.043 | 0.073 |
| $RuO_2$ coat only on Ti base Ru 1 mg/cm² | 0.2 | 0.73 | 0.93 |

Weight losses on samples prepared according to the present invention were determined under simulated operating conditions and compared with weight losses determined under the same conditions on titanium base samples coated with a Pt-Ir alloy. The tests were conducted in NaCl saturated solution at 65° C and under an anodic current density of 1 A/cm². Anode potentials were measured by means of a Luggin tip against a saturated calomel electrode and converted to the normal hydrogen electrode scale. The relevant results are summarized in Table II. The integrated weight change, as shown in the next to last column, was positive, that is, increased, for most of the samples prepared according to the present invention; which is an indication that the coating, instead of gradually wearing off and thus decreasing its precious metal oxide content, tends to build up an additional amount of protective semi-conducting face which reaches stability after a short period of operation as shown by Sample C.

On the contrary, the results summarized in Table I show that even the best noble metal alloy coatings suffer a greater wear rate, during operation; while such wear rate is not necessarily to be imputed exclusively to the spalling off of noble metals, it certainly involves also a substantial decrease of the noble metal content in the coating. The amount of noble metals in such noble metal alloy coatings, which is the amount necessary to obtain a satisfactory anode activity and a sufficiently long operating life, is from five to ten times greater than in the semi-conducting rutile or tantalum oxide coatings prepared according to the present invention.

TABLE II

| Sample | Coating Composition | | | | Operating Hours at 1 A/cm² | Anode Pot. Volt (N.H.E.) | Integrated Weight Change, mg/cm² | Wear Rate Grams per ton $Cl_2$ |
|---|---|---|---|---|---|---|---|---|
| B (Ex. II) | $TrO_2$ | (Ir | 0.2 | mg/cm²) | 0 | 1.62 | 0 | — |
| | $RuO_2$ | (Ru | 0.2 | ") | 792 | 1.53 | + 0.3 (weight incr.) | 0 |
| | $TiO_2$ | (Ti | 1.12 | ") | 2000 | 1.59 | + 0.7 (weight incr.) | 0 |
| C (Ex. III) | $IrO_2$ | (Ir | 0.4 | ") | 0 | 1.35 | — | — |
| | $RuO_2$ | (Ru | 0.4 | ") | 860 | 1.36 | + 0.9 (increase) | 0 |
| | $TiO_2$ | (Ti | 0.96 | ") | 2300 | 1.38 | + 0.9 (increase) | 0 |
| D (Ex. IV) | $IrO_2$ | (Ir | 0.2 | ") | 0 | 1.50 | — | — |
| | $RuO_2$ | (Ru | 0.2 | ") | 552 | 1.44 | + 0.75 (increase) | 0 |
| | $TiO_2$ | (Ti | 1.12 | ") | 816 | 1.50 | + 0.4 | 0 |
| E (Ex. V) | $IrO_2$ | (Ir | 0.2 | ") | 0 | 1.45 | — | — |
| | $RuO_2$ | (Ru | 0.2 | ") | 514 | 1.45 | − 0.097 (decrease) | 0.15 |
| | $TaO_2$ | (Ta | ") | | | | | |
| | | | 1.6 | | | | | |
| F (Ex. VI) | $Au_2O_3$ | (Au | 0.075 | ") | 0 | 1.48 | — | — |
| | $RuO_2$ | Cru | 0.225 | ") | 514 | 1.48 | + 0.2 (increase) | 0 |
| | $TiO_2$ | (Ti | 1.2 | ) | | | | |
| G | Pt | ( | 1.44 | ") | 0 | 1.36 | — | — |
| | Ir | ( | 3.36 | ") | 1032 | 1.48 | − 0.25 (decrease) | 0.26 |
| | | | | | 2370 | 1.58 | − 0.9 (decrease) | 0.32 |
| H | Pt | ( | 3.68 | ") | 0 | 1.39 | — | — |
| | Ir | ( | 0.92 | ") | 926 | 1.35 | — | — |
| | | | | | 2940 | 1.39 | − 0.6 | 0.18 |

The average thickness of the final coating is 1.45 microns or 57 micro-inches and the ratio of platinum group metals to non-precious metals in the oxide coatings of the catalytically active semi-conductor coatings of Examples I to X may be between 20 to 100 and 85 to 100.

While we have given some theories to better describe our invention, these are for explanation only and we do not intend to be bound by these theories in the event it is shown that our invention works differently from the theories given.

The word "oxide" in the following claims is intended to cover oxides of titanium and tantalum whether in the form of $TiO_2$ and $Ta_2O_5$, or other oxides of these metals and oxides of other metals capable of forming semi-conductive coatings with oxides of metals from adjacent groups of the Periodic Table, and the words "noble metals" is intended to include the platinum group metals and gold and silver. The titanium dioxide may be in rutile or anatase form.

The base of the electrode may be a valve metal or any metal capable of withstanding the corrosive conditions of an electrolytic chlorine cell, such as high silicon iron (Duriron), cast or pressed magnetite, etc. Our preference, however, is for a titanium or tantalum base.

The electrodes of our invention may be used in any liquid phase or gaseous phase electrolyte, particularly aqueous salt solutions or fused salts. They are dimensionally stable and are not consumed in the electrolytic process and when used in alkali halide electrolytes such as, for example, sodium chloride solutions used for the production of chlorine and sodium hydroxide, our electrodes form the anodes and the cathodes may be mercury, steel or other suitable conductive material. In mercury cells such as typified, for example, in U.S. Pat. Nos. 3,042,602 or No. 2,958,635, or in diaphragm cells such as U.S. Pat. No. 2,987,463, our electrodes are the anodes and are used in place of the graphite anodes shown in these patents and heretofore used in cells of this type.

The semi-conductor coatings conduct the electrolyzing current from the anode bases to the electrolyte through which it flows to the cathode.

Various modifications and changes may be made in the steps described and the solutions and compositions used without departing from the spirit of our invention or the scope of the following claims.

We claim:

1. The method of producing an electrode on a chlorine-resistant metal base from the group consisting of titanium and tantalum, which comprises applying a coating mixture in liquid form to said base which on heating forms a mixture of an oxide of a platinum group metal, oxides from the group consisting of titanium and tantalum and at least one doping oxide from the group consisting of silver, tin, chromium, lanthanum, cobalt, antimony, molybdenum, nickel, iron, tungsten, vanadium, phosphorus, boron, beryllium, sodium, calcium, strontium, lead, copper and bismuth, and mixtures thereof, the percentage of doping oxide in said coating mixture being between 0.10 and 50% of the material from the group consisting of oxides of titanium and tantalum and the ratio of platinum group metals to the non-precious metals in said coating being between 20:100 and 85:100, all said percentages being based upon the metals in said oxides; applying said coating mixture and heating the coating on the chlorine-resistant metal base until oxides of the metals in said coating mixture have been produced.

2. The method of claim 1 in which the coating mixture is applied in several separate layers and heated in an oxidizing temperature between the application of each layer.

3. The method of claim 1 in which the coating mixture is applied to said base by electrostatic spray.

4. The method of claim 1 in which the titanium in said coating mixture is converted to a pertitanate before application of the coating mixture to said base.

5. The method of claim 1 in which the coating mixture is applied in multiple layers on the metal base and the doping oxide consists of tin and at least one oxide of a metal from the group consisting of tantilum, lanthanum, chromium and aluminum.

6. The method of producing an electrode on a chlorine-resistant metal base from the group consisting of titanium and tantalum having a semi-conductor coating thereon, which comprises applying a coating mixture in liquid form to said base, which coating mixture on heating forms (a) a platinum group metal oxide, (b) a metal oxide from the group consisting of titanium or tantalum and (c) a doping oxide from the group consisting of silver, tin, chromium, lanthanum, aluminum, cobalt, antimony, molybdenum, nickel, iron, tungsten, vanadium, phosphorus, boron, beryllium, sodium, calcium, strontium, lead, copper and bismuth, and mixtures thereof, the percentage of doping oxide in said coating being between 0.10 and 50% of the metal oxide from the group consisting of titanium oxide and tantalum oxide and the ratio of platinum group metals to the non-precious metals in said coatings being between 20:100 and 85:100, all said percentages being based upon the metal in said oxides; applying said coating mixture on said base and heating the coating on said base until oxides of the metals in said coating mixture have been produced.

7. The method of claim 6 in which the coating contains an oxide of a platinum group metal in sufficient amount to catalyze chlorine discharge from the anode in a chlorine cell.

8. The method of claim 6 in which the coating mixture includes oxides of two platinum group metals.

9. The method of claim 6 in which the oxides of platinum group metals are ruthenium oxide and iridium oxide.

10. The method of producing an electrode comprising a chlorine-resistant metal base from the group consisting of titanium and tantalum having a semi-conductor coating thereon, which comprises applying a coating mixture in liquid form to said base, which coating mixture on heating forms (a) a platinum group metal oxide, (b) a metal oxide from the group consisting of titanium and tantalum and (c) at least one doping oxide from the group consisting of oxides of vanadium, tantalum, tin, cobalt, lanthanum and aluminum, and heating said coating mixture on said base until the oxides of said metals are produced, the percentage of doping oxide in said coating mixture being between 0.10 and 50% of the material from the group consisting of oxides of titanium and tantalum and the ratio of platinum group metals to the non-precious metals in said coating being between 20:100 and 85:100, all said percentages being based upon the metals in said oxides.

11. The method of producing an electrode comprising a chlorine-resistant metal base from the group consisting of titanium and tantalum having a semi-conductor coating thereon, which comprises applying a coating mixture in liquid form to said base, which coating mixture on heating forms (a) ruthenium oxide, (b) titanium dioxide and (c) at least one doping oxide from the group consisting of oxides of tantalum, tin, lanthanum, cobalt, vanadium, aluminum, nickel and iron, and heating said coating mixture on said base until the oxides of said metals are produced.

12. The method of producing an electrode on a chlorine-resistant metal base from the group consisting of titanium and tantalum, which comprises applying a thermally-reducible coating mixture in liquid form to said base which, on heating, forms an oxide of a platinum group metal, and an oxide of titanium, the ratio of platinum group metals to the non-precious metals in said mixture being between 20:100 and 85:100, said percentages being based upon the metals in said oxides, converting the titanium in said mixture into a pertitanate before application of the coating to said base and heating the coating on the chlorine-resistant metal base until oxides of the metals in said coating mixture have been produced.

13. The method of claim 12 in which the coating mixture is applied in several separate layers and heated between the application of each layer.

14. The method of producing a semi-conductor face on an electrode support comprising a chlorine-resistant metal base, which comprises applying a thermally reducible coating mixture in liquid form to said electrode support which on heating forms a mixture of an oxide of a platinum group metal, oxides from the group consisting of titanium and tantalum and at least one doping oxide from the group consisting of silver, tin, chromium, lanthanum, aluminum, cobalt, antimony, molybdenum, nickel, iron, tungsten, vanadium, phosphorus, boron, beryllium, sodium, calcium, strontium, lead, copper and bismuth, and mixtures thereof, the percentage of doping oxide being between 0.10 and 50% of the material from the group consisting of oxides of titanium and tantalum and the ratio of platinum group metals to the non-precious metals in said coating being between 20:100 and 85:100, all said percentages being based upon the metals in said oxides; applying said coating mixture and heating the coating on the support until oxides of the metals in said coating mixture have been produced.

15. The method of claim 14 in which the coating mixture is applied in several separate layers and heated in air between the application of each layer.

16. The method of claim 14 in which the coating mixture is applied to said support by electrostatic spray.

17. The method of claim 14 in which the titanium in said coating mixture is converted to a pertitanate before application of the coating mixture to said support.

18. The method of increasing the non-stoichiometry of platinum group metal oxides and valve metal oxides from the group consisting of titanium and tantalum on a chlorine-resistant metal base from the group consisting of titanium and tantalum, which comprises applying a coating mixture in liquid form to said base which on heating forms a mixture of an oxide of a platinum group metal, oxides from the group consisting of titanium and tantalum and at least one other oxide from the group consisting of silver, tin, chromium, lanthanum, cobalt, antimony, molybdenum, nickel, iron, tungsten, vanadium, phosphorus, boron, beryllium, sodium, calcium, strontium, lead, copper and bismuth, and mixtures thereof, the percentage of said other oxide in said coating mixture being between 0.10 and 50% of the material from the group consisting of oxides of titanium and tantalum and the ratio of platinum group metals to the non-precious metals in said coating being between 20:100 and 85:100, all said percentages being based upon the metals in said oxides, applying said coating mixture and heating the coating on the chlorine-resistant metal base until oxides of the metals in said coating mixture have been produced.

19. The method of claim 18 in which the coating mixture is applied in several separate layers and heated in an oxidizing atmosphere between the application of each layer.

20. The method of increasing the non-stoichiometry of electrocatalysts from the group consisting of platinum group metal oxides and valve metal oxides from the group consisting of titanium and tantalum, which comprises forming a liquid mixture which on heating forms a mixture of an oxide of a platinum group metal, oxides from the group consisting of titanium and tantalum and at least one other oxide from the group consisting of silver, tin, chromium, lanthanum, cobalt, antimony, molybdenum, nickel, iron, tungsten, vanadium, phosphorus, boron, beryllium, sodium, calcium, strontium, lead, copper and bismuth, and mixtures thereof, the percentage of said other oxide in said coating mixture being between 0.10 and 50% of the material from the group consisting of oxides of titanium and tantalum and the ratio of platinum group metals to the non-precious metals in said coating being between 20:100 and 85:100, all said percentages being based upon the metals in said oxides, and heating said mixture in an oxidizing atmosphere until oxides of the metals in said mixture have been produced.

* * * * *